US007154224B2

(12) United States Patent
Woo et al.

(10) Patent No.: US 7,154,224 B2
(45) Date of Patent: Dec. 26, 2006

(54) PLASMA DISPLAY PANEL

(75) Inventors: Seok-Gyun Woo, Suwon-si (KR); Chong-Gi Hong, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 86 days.

(21) Appl. No.: 11/105,451

(22) Filed: Apr. 14, 2005

(65) Prior Publication Data

US 2005/0231111 A1 Oct. 20, 2005

(30) Foreign Application Priority Data

Apr. 20, 2004 (KR) ..... 10-2004-0027158

(51) Int. Cl.
*H01J 17/49* (2006.01)

(52) U.S. Cl. ..... 313/582; 313/586

(58) Field of Classification Search ..... 313/582, 313/586

See application file for complete search history.

(56) References Cited

U.S. PATENT DOCUMENTS 5,004,950 A * 4/1991 Lee ..... 313/582

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristitcs; Annex C—Gaps and Annex D—Manufacturing.

*Primary Examiner*—Nimeshkumar D. Patel
*Assistant Examiner*—Anthony Perry
(74) *Attorney, Agent, or Firm*—Robert E. Bushnell, Esq.

(57) ABSTRACT

A plasma display panel (PDP) includes: a front substrate; a rear substrate disposed in opposition to the front substrate; first barrier ribs disposed between the front substrate and the rear substrate, defining discharge cells with the front substrate and the rear substrate, and formed of a dielectric material; front discharge electrodes disposed inside the first barrier ribs so as to surround the discharge cells; rear discharge electrodes disposed inside the first barrier ribs so as to surround the discharge cells, and spaced apart from the front discharge electrodes; phosphor layers disposed in the discharge cells; and a discharge gas deposited in the discharge cells. With respect to a longitudinal sectional view of the first barrier ribs, a virtual horizontal axis which extends from a lowermost portion of each of the rear discharge electrodes and is parallel to the front substrate intersects a lateral surface of the first barrier ribs at a certain position. An angle between a tangent line at the intersection of the horizontal axis and a lateral surface of the first barrier ribs, on one hand, and a virtual vertical axis orthogonal to the horizontal axis, on the other hand, ranges from 4° to 17°.

9 Claims, 7 Drawing Sheets

U.S. PATENT DOCUMENTS 5,371,437 A * 12/1994 Amano ..... 315/169.1
5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,744,909 A * 4/1998 Amano ..... 313/585
5,786,794 A 7/1998 Kishi et al.
5,952,782 A 9/1999 Nanto
RE37,444 E 11/2001 Kanazawa
6,630,916 B1 10/2003 Shinoda
6,707,436 B1 3/2004 Setoguchi et al.
6,873,105 B1 * 3/2005 Akiba ..... 313/586
7,015,643 B1 * 3/2006 Kweon ..... 313/583
7,067,978 B1 * 6/2006 Kwon et al. ..... 313/582

FOREIGN PATENT DOCUMENTS

JP 2845183 10/1998
JP 2917279 4/1999
JP 2001-043804 2/2001
JP 2001-325888 11/2001

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 20 Apr. 2004 and there duly assigned Serial No. 10-2004-0027158.

BACKGROUND OF THE INVENTION

1. Technical Field

The present invention relates to a plasma display panel (PDP) and, more particularly, to a PDP with a new structure.

2. Related Art

A device adopting a plasma display panel (PDP) has not only a large screen but also some excellent characteristics, such as high definition (HD), ultra-thin thickness, light weight, and wide viewing angle. Also, in comparison with other flat panel displays, the device including the PDP can be manufactured in a simple process can be easily fabricated in a large size, so that it has attracted much attention as the next generation of flat panel devices.

A PDP can be classified into a direct current (DC) PDP, an alternating current (AC) PDP, and a hybrid PDP according to the type of discharge voltage applied to it. The PDP can also be divided into an opposing discharge type PDP and a surface discharge type PDP according to the discharge structure. In recent years, an AC surface discharge type triode PDP has typically been used.

In the PDP, a considerable amount (about 40%) of visible rays emitted from phosphor layers are absorbed in scan electrodes, common electrodes, bus electrodes, a dielectric layer covering the electrodes, and a magnesium oxide (MgO) protective layer, which are disposed on a bottom surface of a front substrate. Thus, luminous efficiency is low.

Furthermore, when the surface discharge type triode PDP displays the same image for a long period of time, the phosphor layers are ion-sputtered due to charged particles of the discharge gas, thus causing a permanent image sticking.

SUMMARY OF THE INVENTION

The present invention provides a plasma display panel (PDP) with improved luminous efficiency.

According to an aspect of the present invention, there is provided a PDP including: a front substrate; a rear substrate disposed opposite to the front substrate; first barrier ribs which are disposed between the front substrate and the rear substrate for defining discharge cells with the front substrate and the rear substrate, and which are formed of a dielectric material; front discharge electrodes disposed inside the first barrier ribs so as to surround the discharge cells; rear discharge electrodes disposed inside the first barrier ribs so as to surround the discharge cells and spaced apart from the front discharge electrodes; phosphor layers disposed in the discharge cells; and a discharge gas which fills the discharge cells. From a longitudinal sectional view of the first barrier ribs, a virtual horizontal axis, which extends from a lowermost portion of each of the rear discharge electrodes and which is parallel to the front substrate, intersects a lateral surface of the first barrier ribs at a certain position. An angle between a tangent line at the intersection of the horizontal axis and the lateral surface of the first barrier ribs, on one hand, and a virtual vertical axis orthogonal to the horizontal axis, on the other hand, ranges from 4° to 17°.

The front discharge electrodes may extend in a given direction, and the rear discharge electrodes may extend in a direction which crosses the given direction in which the front discharge electrodes extend. Also, the front discharge electrodes and the rear discharge electrodes may extend in directions parallel to each other. The PDP of the present invention may further include address electrodes which extend in a direction which crosses the direction in which the front discharge electrodes and the rear discharge electrodes extend.

According to the present invention, an MgO protective layer is formed to a uniform thickness on the lateral surface of the first barrier rib, and a sustain voltage margin is sufficient. As a result, uniform plasma discharge occurs, thus improving discharge properties and luminous efficiency.

Also, surface discharge can be induced from all of the lateral surfaces of a discharge space so that the discharge surface can be greatly enlarged.

Furthermore, as discharge occurs from the lateral surfaces of the discharge cells and spreads toward the centers of the discharge cells, the discharge region notably increases, thus enabling efficient utilization of the entirety of the discharge cells. Accordingly, the PDP can be driven at a low voltage so that luminous efficiency is considerably enhanced.

In addition, because the PDP can be driven at a low voltage, even if a high-concentration Xe gas is used as a discharge gas, luminous efficiency improves.

Moreover, since an electric field caused by a voltage applied to the discharge electrode formed on the lateral surface of the discharge space crowds plasma into the center of the discharge space, even if discharge occurs for a long period of time, collision of generated ions with the phosphor layers due to the electric field is prevented. This inhibits the phosphor layers from being ion-sputtered, with the result that no permanent image sticking is caused.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
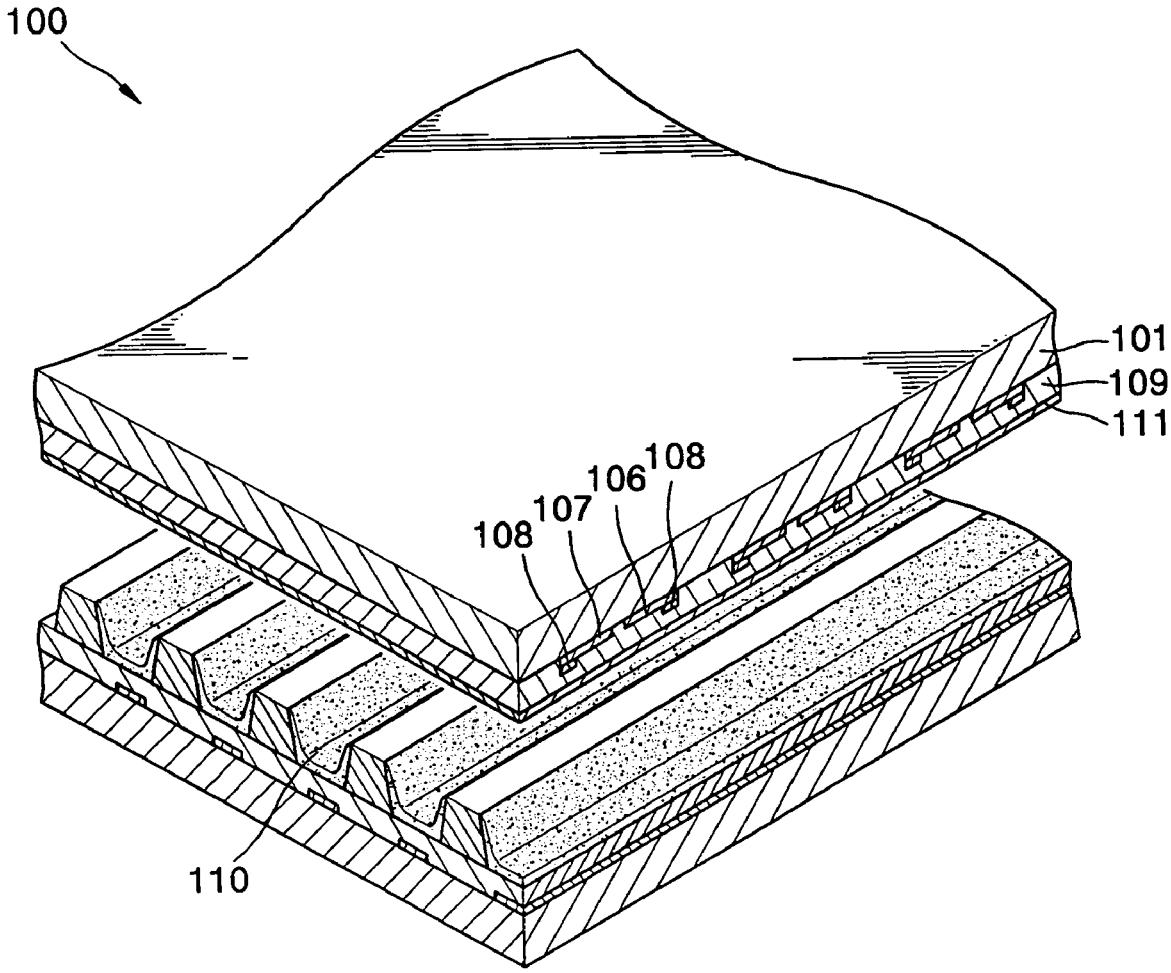
FIG. 1 is an exploded perspective view of a plasma display panel (PDP)

FIG. 1 is an exploded perspective view of a plasma display panel (PDP), and in particular a surface discharge type triode PDP. In the PDP 100 of FIG. 1, a considerable amount (about 40%) of visible rays emitted from phosphor layers 110 are absorbed in scan electrodes 106, common electrodes 107, bus electrodes 108, a dielectric layer 109 covering the electrodes 106, 107 and 108, and an MgO protective layer 111, which are disposed on a bottom surface of a front substrate 101. Thus, luminous efficiency is low.

Furthermore, when the surface discharge type triode PDP 100 displays the same image for a long period of time, the phosphor layers 110 are ion-sputtered due to charged particles of the discharge gas, thus causing permanent image sticking.

A plasma display panel (PDP) according to an exemplary embodiment of the present invention will now be described with reference to FIGS. 2 through 7.

Figure 2:
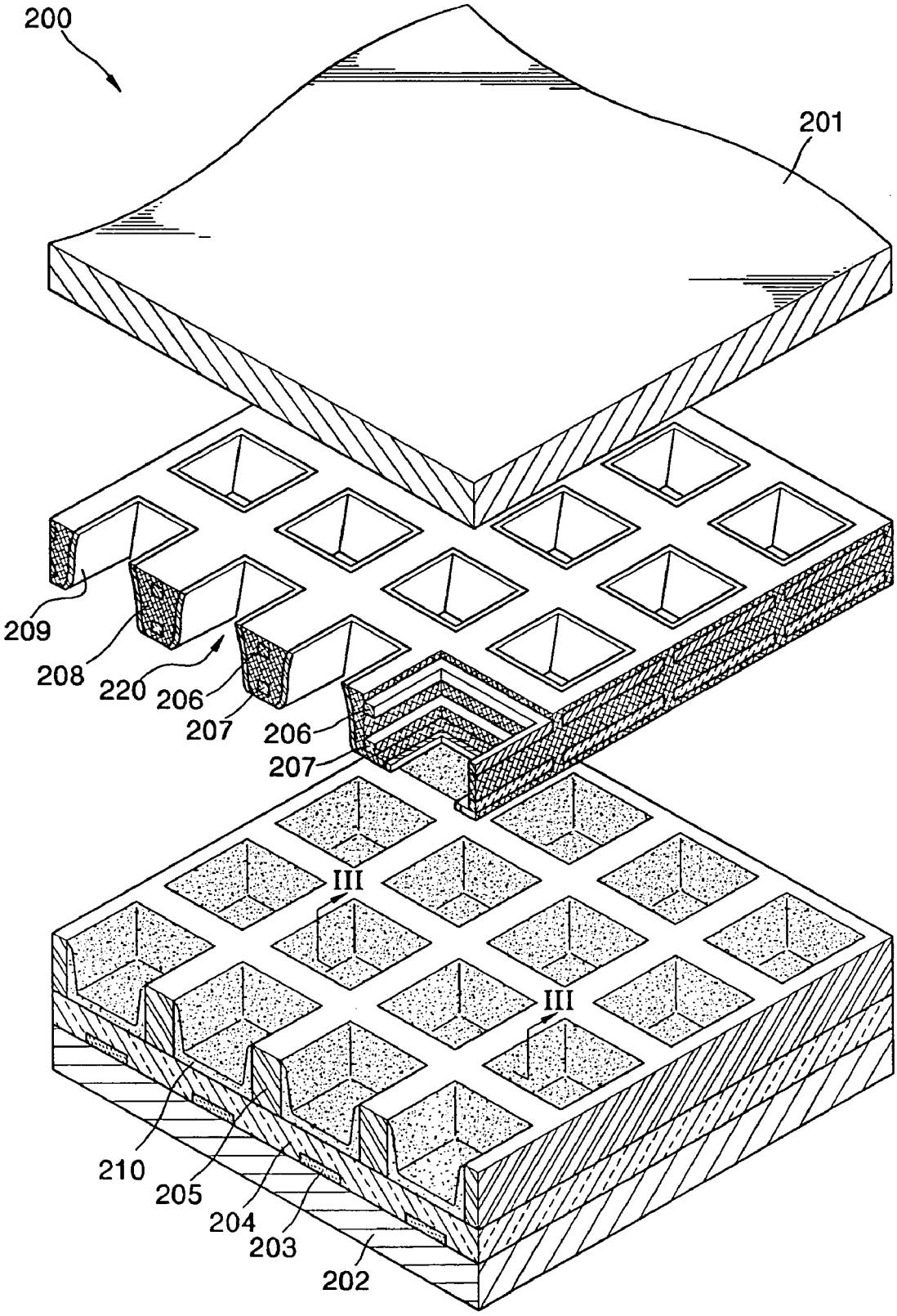
FIG. 2 is a cutaway exploded perspective view of a PDP according to an exemplary embodiment of the present invention.
Figure 3:
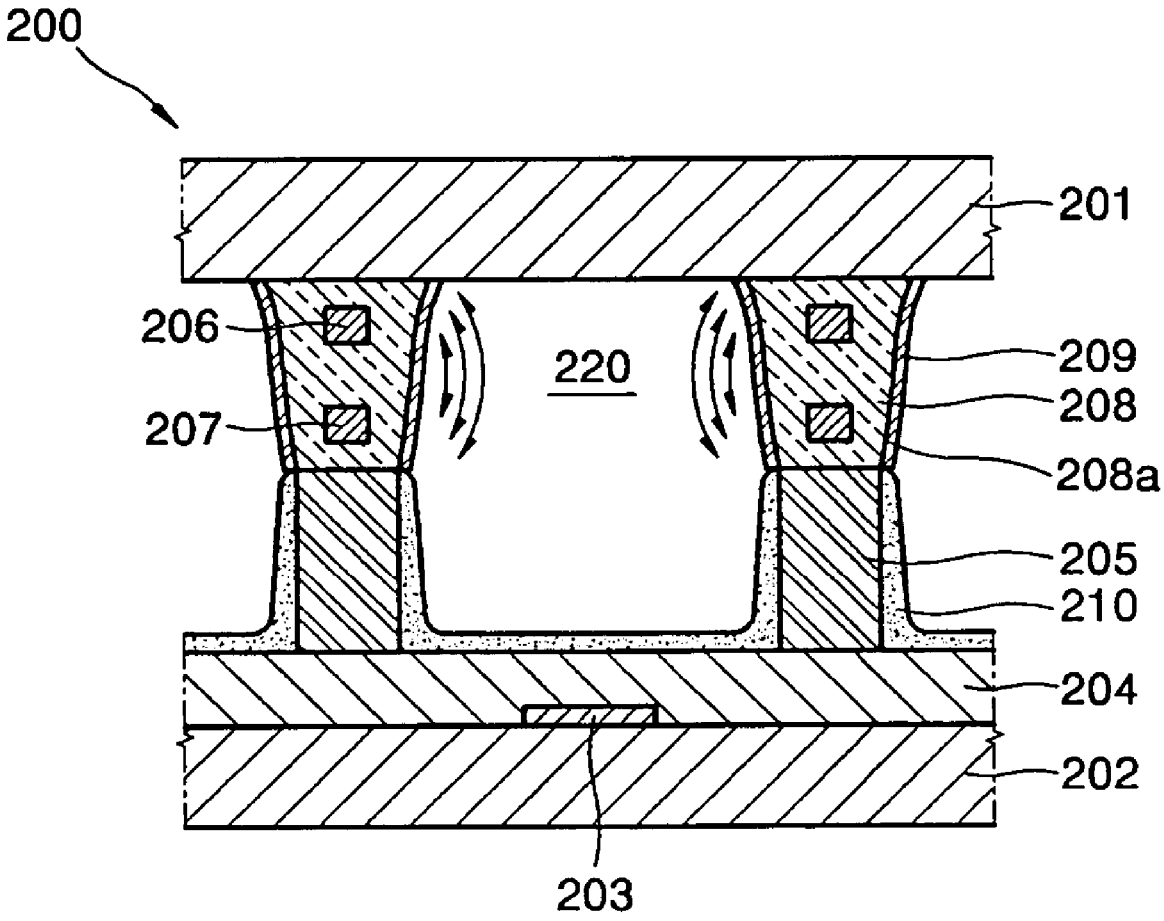
FIG. 3 is a cross sectional view taken along lines III—III of FIG. 2.
Figure 4:
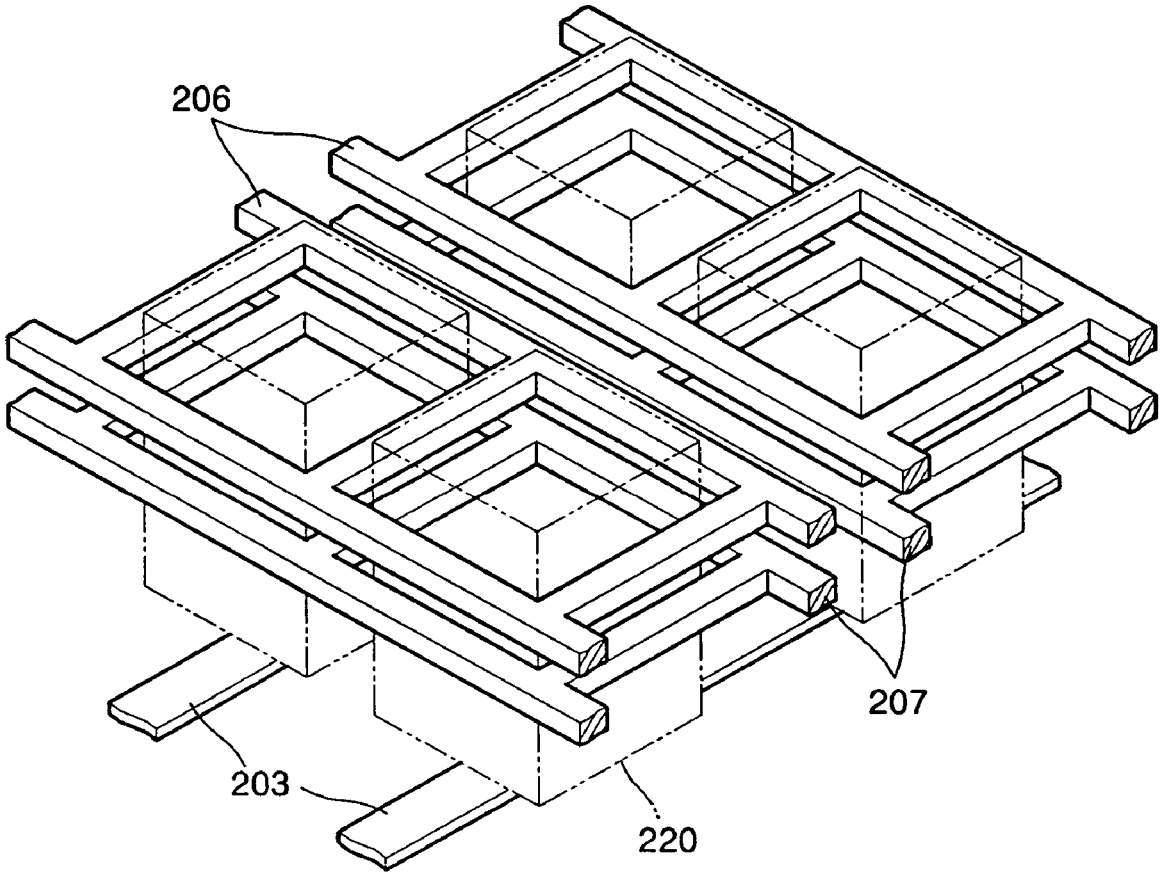
FIG. 4 is a perspective view of discharge cells and electrodes shown in FIG. 2.

FIG. 2 is a cutaway exploded perspective view of a PDP according to an exemplary embodiment of the present invention, while FIG. 3 is a cross sectional view taken along lines III—III of FIG. 2, and FIG. 4 is a perspective view of discharge cells and electrodes shown in FIG. 2.

Referring to FIGS. 2 and 3, PDP 200 includes a front substrate 201, a rear substrate 202, address electrodes 203, a dielectric layer 204, first barrier ribs 208, second barrier ribs 205, front discharge electrodes 206, rear discharge electrodes 207, MgO layers 209 and phosphor layers 210. The rear substrate 202 is disposed parallel and opposite to the front substrate 201. The first barrier ribs 208 are disposed between the front substrate 201 and the rear substrate 202, they define discharge cells 220 with the front and rear substrate 201 and 202, and they are formed of a dielectric material. The front discharge electrodes 206 are disposed inside the first barrier ribs 208 so as to surround the discharge cells 220. The rear discharge electrodes 207 are disposed inside the first barrier ribs 208 so as to surround the discharge cells 220, and they are spaced apart from the front discharge electrodes 206. The phosphor layers 210 are disposed in the discharge cells 220, which are filled with a discharge gas (not shown).

In the exemplary embodiment of the present invention, since visible rays from the discharge cells 220 are transmitted through the front substrate 201 and then externally emitted, the front substrate 201 is formed of a material, such as glass, having good transmissivity. The front substrate 201 of the present invention transmits visible rays in the forward direction much better because it does not include scan electrodes, common electrodes, and bus electrodes, as compared with the front substrate of the PDP 100. Therefore, if an image is embodied at the ordinary level of luminance, the scan electrodes 106, common electrodes 107 and bus electrodes 108 are driven at a relatively low voltage so that luminous efficiency improves.

The first barrier ribs 208 disposed under the front substrate 201 define the discharge cells 220, each of which corresponds to red, green or blue emitting sub-pixels that form one pixel. Also, the first barrier ribs 208 prevent generation of a misdischarge between the discharge cells 220. As shown in FIG. 4, the first barrier ribs 208 are formed such that the discharge cells 220 are partitioned in a rectangular matrix shape.

The first barrier ribs 208 prevent an electrical short between the front discharge electrodes 206 and the rear discharge electrodes 207 and inhibit charged particles from directly colliding with the front discharge electrode 206 and the rear discharge electrode 207, and damaging the same. The first barrier ribs 208 may be formed of a dielectric material, such as PbO, $B_2O_3$, or $SiO_2$, which can accumulate wall charge by inducing charged particles.

As shown in FIG. 4, the front discharge electrodes 206 and the rear discharge electrodes 207 are disposed inside the first barrier ribs 208 such that the discharge cells 220 are surrounded. The front discharge electrode 206 and rear discharge electrode 207 are formed of a conductive metal, such as Al or Cu. Also, the front discharge electrodes 206 and rear discharge electrodes 207 are spaced apart from each other, and extend parallel to each other in a vertical direction relative to the front substrate 201. In this case, the front discharge electrodes 206 and the rear discharge electrodes 207 are symmetric with respect to a virtual surface which is parallel to the front substrate 201.

Also, when the distance between a scan electrode and an address electrode is small, address discharge is efficiently provoked. Accordingly, in the exemplary embodiment of the present invention, the rear discharge electrodes 207 act as scan electrodes because they are close to the address electrodes 203, while the front discharge electrodes 206 act as common electrodes. However, even if address electrodes are not used, address discharge between the front discharge electrodes 206 and rear discharge electrodes 207 is enabled. Thus, the present invention is not limited to PDPs which include address electrodes. Although not shown in the drawings, if no address electrodes are formed, the rear discharge electrodes 207 extend in a direction so as to cross the direction in which the front discharge electrodes 206 extend.

The rear substrate 202 supports the address electrodes 203 and the dielectric layer 204, and is typically formed of glass as the main element.

The address electrodes 203 are disposed on a front surface of the rear substrate 202. The address electrodes 203 extend across the front discharge electrodes 206 and the rear discharge electrodes 207.

The address electrodes 203 are used to generate address discharge, which facilitates sustain discharge between the front discharge electrodes 206 and the rear discharge electrodes 207. More specifically, the address electrodes 203 aid in lowering the voltage at which sustain discharge begins. Address discharge refers to discharge induced between a scan electrode and an address electrode. Once the address discharge ends, positive ions are accumulated in the scan electrode, and electrons are accumulated in a common electrode, thereby facilitating sustain discharge between the scan electrode and the common electrode.

The dielectric layer 204 in which the address electrodes 203 are buried is formed of a dielectric material, such as PbO, $B_2O_3$, or $SiO_2$, which prevents positive ions or electrons from colliding with and damaging the address electrodes 203 during discharge, and also induces charges.

The PDP 200 of the present invention may further include second barrier ribs 205, which are disposed between the first barrier ribs 208 and the rear substrate 202, and which define the discharge cells 220 together with the first barrier ribs 208. Although FIG. 2 illustrates that the first barrier ribs 208 and the second barrier ribs 205 are partitioned in a matrix shape, the present invention is not limited thereto. As long as it is possible to form a plurality of discharge spaces, the first barrier ribs 208 and second barrier ribs 205 may have a variety of patterns. For example, the first barrier ribs 208 and second barrier ribs 205 may have not only open patterns, such as stripes, but also closed patterns, such as waffles, matrixes, and deltas. Also, in addition to the rectangular cross sections as in the present embodiment, closed barrier ribs may be formed such that the cross sections of discharge spaces are polygonal (e.g., triangular or pentagonal), circular, or elliptical. In the present embodiment of the present invention, the first barrier ribs 208 and the second barrier ribs 205 have the same shape, but may have different shapes.

As shown in FIG. 4, the phosphor layers 210 substantially form a planar top surface with the second barrier ribs 205. Preferably, the phosphor layers 210 are coated on the lateral surfaces of the second barrier ribs 205, and on the rear substrate 202 between the second barrier ribs 205.

The phosphor layers 210 contain elements that absorb ultraviolet rays and emit visible rays. Namely, phosphor layers in a red emitting sub-pixel contain a fluorescent material such as Y(V,P)O4:Eu, phosphor layers in a green emitting sub-pixel contain a fluorescent material such as $Zn_2SiO_4$:Mn or $YBO_3$:Tb, and phosphor layers in a blue emitting sub-pixel contain a fluorescent material such as BAM:Eu.

A discharge gas, for example, Ne, Xe, or a mixture thereof, is injected into the discharge cells 220, and the discharge cells 220 are sealed. In the present invention, because the discharge surface can increase and discharge regions can be enlarged, the amount of generated plasma increases, thus enabling a low-voltage driving of the PDP 200. Accordingly, even if high-concentration Xe gas is used as a discharge gas, the PDP 200 can be driven at a low voltage so that luminous efficiency is greatly enhanced. This solves the problems of a PDP which cannot be driven at a low voltage when a high-concentration Xe gas is used as a discharge gas.

At least the lateral surfaces of the first barrier rib 208 may be covered by the protective layer 209, which is formed of MgO. The MgO layer 209 is not an indispensable element, but it prevents charged particles from colliding with and damaging the first barrier ribs 208 formed of a dielectric material, and it also emits a lot of secondary electrons during discharge.

The MgO layer 209 is typically formed using deposition methods after the first barrier ribs 208 are formed. It is possible to use non-vacuum deposition techniques, such as spray pyrolysis, but the MgO layer 209 is generally obtained by methods using MgO as a source. For instance, an MgO source is dissolved using e-beam methods and evaporated, or MgO is sputtered and deposited.

However, if the MgO layer 209 is deposited by emitting an MgO gas toward the front substrate 201, since lateral surfaces 208*a* of the first barrier ribs 208 are sloped downward as shown in FIG. 3, it is highly feasible that the MgO layer 209 formed on the lateral surfaces 208*a* of the first barrier ribs 208 have a non-uniform thickness. Also, because the MgO may flow down the slopes of the lateral surfaces 208 of the first barrier ribs 208, it is harder to obtain a uniform thickness of the MgO layer 209. Therefore, in order to form the MgO layer 209 with a uniform thickness, the lateral surfaces 208*a* of the first barrier ribs 208 should be appropriately formed.

Figure 8:
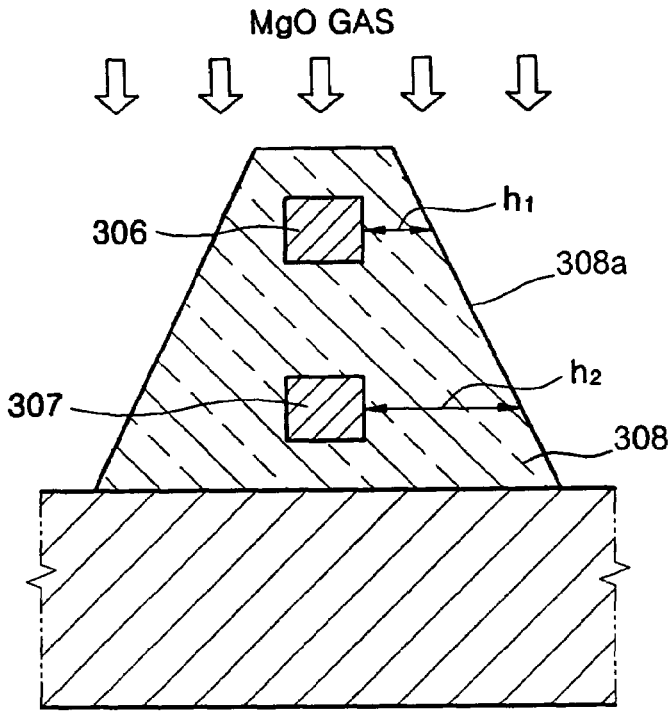
FIG. 8 is a magnified longitudinal sectional view of the first barrier ribs when a tangent angle is more than 0°.

In particular, portions of the lateral surfaces 208*a*, on which concentrated discharge from the front discharge electrodes 206 and rear discharge electrodes 207 are projected, greatly affect the thickness of the MgO layer 209. If the gradient of the lateral surface 308*a* is too high as shown in FIG. 8, a difference occurs between the depths $h_1$ and $h_2$ of portions of a first barrier rib 308 that covers a front discharge electrode 306 and a rear discharge electrode 307, respectively. As a result, the amount of wall charge accumulated on both of the electrodes 306 and 307 become different during discharge, thus inducing non-uniform discharge.

Figure 9:
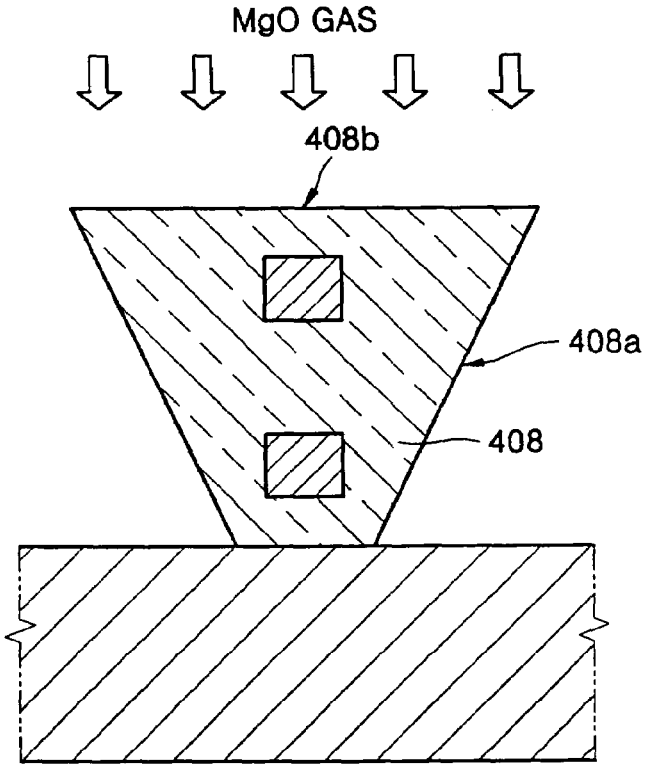
FIG. 9 is a magnified longitudinal sectional view of the first barrier ribs when a tangent angle is less than 0°.

However, if the gradient of the lateral surface 408*a* is too low, i.e., a minus value, as shown in FIG. 9, since the lateral surface 408 as of a first barrier rib 408 is blocked by a bottom surface 408*b* of the first barrier rib 408, no MgO layer is formed on the lateral surface 408*a*. Even if the MgO layer 209 is deposited on the lateral surface 408*a*, the MgO flow is downward so that it cannot be formed to a uniform thickness.

Accordingly, as described above, in order to deposit the MgO layer 209 with a uniform thickness, the shape of the first barrier rib 208 should be determined in consideration of positions of the front discharge electrodes 206 and rear discharge electrodes 207, such that the lateral surfaces 208*a* have an appropriate gradient.

The present invention obtains such an appropriate shape of the lateral surface 208*a* as to render uniform the thickness of the MgO layer 209 based on the rear discharge electrodes 207 on which discharge is concentrated, and the first barrier ribs 208 are formed at a relatively high gradient. Hereinafter, a lateral line 208*b* (FIG. 5) of the lateral surface 208*a* will be chiefly observed and described.

Figure 5:
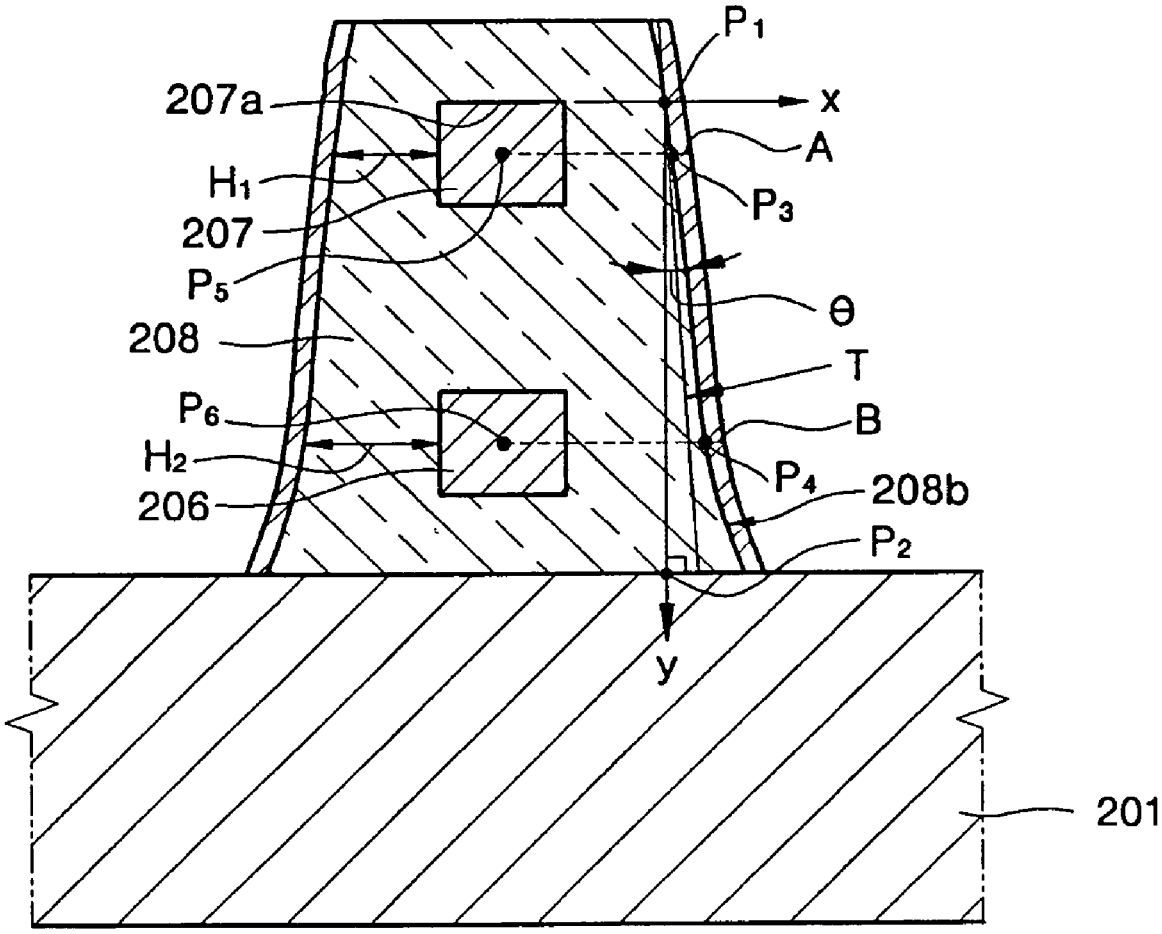
FIG. 5 is a magnified cross sectional view of a first barrier rib and an MgO layer shown in FIG. 2.

FIG. 5 is a magnified longitudinal sectional view of a first barrier rib and an MgO layer shown in FIG. 2.

Referring to FIG. 5, from the longitudinal sectional view of the first barrier rib 208, a virtual horizontal axis (x-axis), which extends from a lowermost portion 207*a* of the rear discharge electrode 207 and is parallel to the front substrate 201, is considered. The horizontal axis (x-axis) intersects the lateral line 208*b* of the first barrier rib 208 at a first position $P_1$. Also, a virtual vertical axis (y-axis), which is orthogonal to the horizontal axis (x-axis) at the first position $P_1$, intersects the front substrate 201 at a second position $P_2$. In this case, a tangent angle θ, between a tangent line T and the vertical axis (y-axis) at the first position $P_1$ becomes a parameter that represents the gradient of the lateral line 208*b*.

Figure 6:
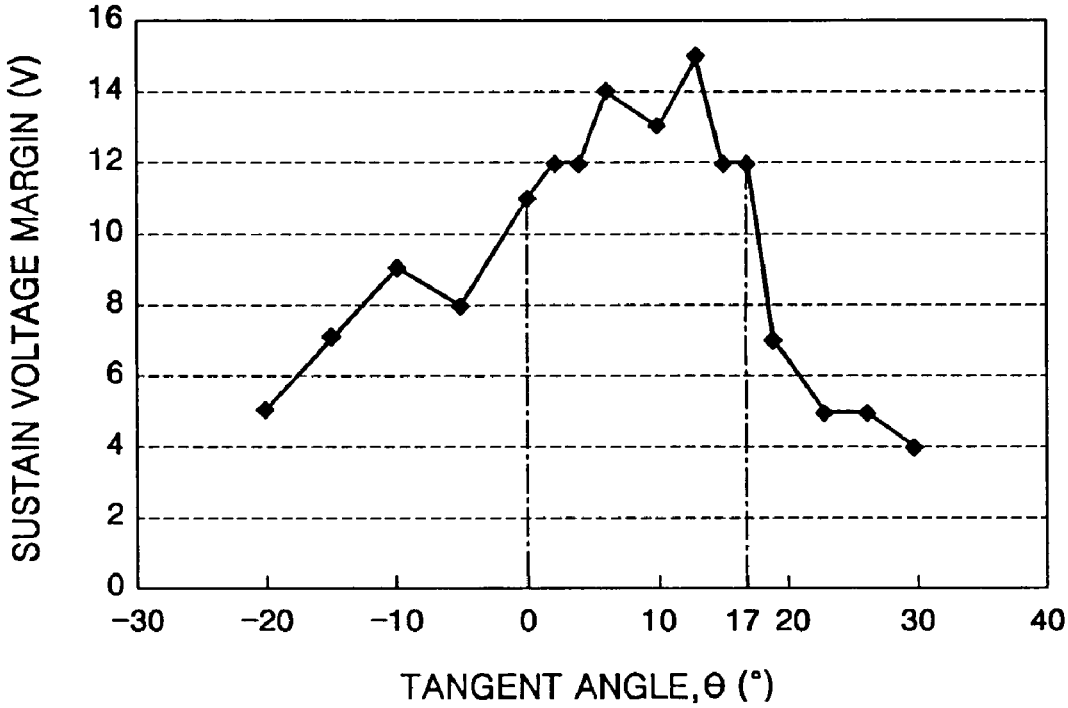
FIG. 6 is a graph of a sustain voltage margin with respect to a tangent angle.
Figure 7:
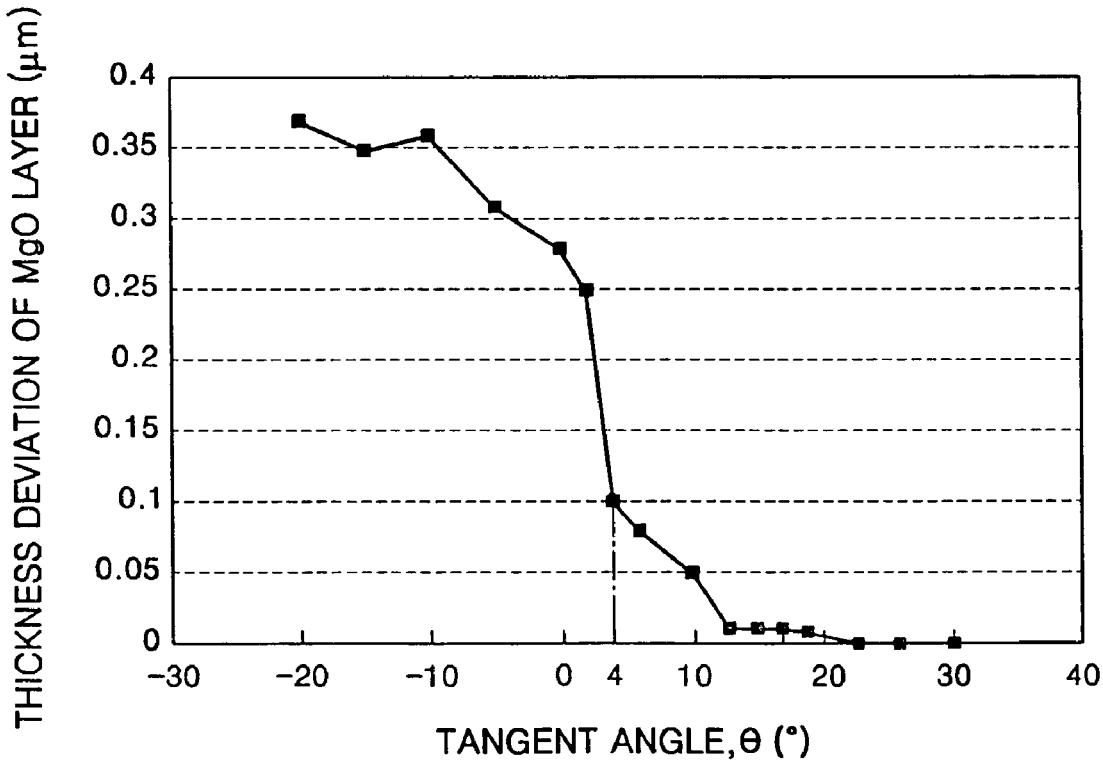
FIG. 7 is a graph of a thickness deviation of the MgO layer with respect to a tangent angle.

FIG. 6 is a graph of a sustain voltage margin with respect to a tangent angle, and FIG. 7 is a graph of a thickness deviation of the MgO layer with respect to a tangent angle.

Referring to FIG. 6, when a tangent angle θ is 13°, the sustain voltage margin has a maximum of 15 V, and is generally distributed in a convex shape. When the tangent angle θ is less than 0° or more than 17°, the sustain voltage margin is greatly reduced. If an absolute value of the tangent angle θ is too great, a gradient is increased as much. This results in a difference between the depths $H_1$ and $H_2$ of portions of the first barrier rib 208 that cover the front and rear discharge electrodes 206 and 207 as described above. Consequently, the amount of wall charge accumulated on both of the electrodes 206 and 207 becomes different during discharge, thus causing non-uniform discharge.

In FIG. 7, the thickness deviation |A−B| of the MgO layer 209 refers to an absolute value of the difference between a thickness A of the MgO layer 209, obtained at a third position ($P_3$ of FIG. 5), and a thickness B of the MgO layer 209, obtained at a fourth position ($P_4$ of FIG. 5). Referring to FIG. 5, a virtual line which extends from a vertical center $P_5$ of the rear discharge electrode 207 and is parallel to the horizontal axis (x-axis) intersects the lateral line 208*b* of the first barrier rib 208 at the third position $P_3$. Also, a virtual line which extends from a vertical center $P_6$ of the front discharge electrode 206 and is parallel to the horizontal axis (x-axis) intersects the lateral line 208*b* of the first barrier rib 208 at the fourth position $P_4$.

Referring to FIG. 7, it can be observed that, as the tangent angle θ decreases, the thickness of the MgO layer 209 becomes more non-uniform, because the lateral line 208*b* of the first barrier rib 208 is disposed in a more slanted orientation relative to the direction in which a MgO source is emitted. Particularly, when the tangent angle θ is less than 4°, the thickness deviation |A−B| of the MgO layer 209 increases. Accordingly, when the tangent angle θ is less than 4°, discharge is non-uniformly generated and discharge properties are degraded.

Therefore, it is concluded from FIGS. 6 and 7 that the tangent angle θ should range from 4° to 17° in order to obtain a sufficient sustain voltage margin and an MgO layer with a uniform thickness.

A method of driving the PDP 200 having the above-described structure will now be described.

At the outset, by applying an address voltage between the address electrodes 203 and the rear discharge electrodes 207, address discharge is induced, with the result that one discharge cell 220 on which sustain discharge will be generated is selected.

Thereafter, if an alternating current (AC) sustain discharge voltage is applied between the front discharge electrode 206 and the rear discharge electrode 207 of the selected discharge cell 220, sustain discharge is induced between the front discharge electrodes 206 and rear discharge electrodes 207. As the energy level of a discharge gas excited by the sustain discharge is lowered, ultraviolet rays are emitted. Then, the ultraviolet rays excite the phosphor layer 210 coated inside the discharge cell 220. As the energy level of the excited phosphor layer 210 is lowered, visible rays are emitted. The emitted visible rays form an image.

In the PDP 100 shown in FIG. 1, because sustain discharge is horizontally generated between the scan electrodes 106 and the common electrodes 107, the discharge area is relatively narrow. On the other hand, in the PDP 200 of the present invention, sustain discharge is generated from all of the lateral surfaces that define the discharge cell 220, and thus the discharge area is relatively wide.

Also, in the exemplary embodiment of the present invention, the sustain discharge is induced in the form of a closed curve along the lateral surfaces of the discharge cell 220, and then gradually spread toward the center of the discharge cell 220. Thus, the volume of a region where the sustain discharge occurs is increased. Moreover, even space charges of the discharge cell 220, which are not conventionally utilized, contribute to luminescence. As a result, the luminous efficiency of the PDP 200 is enhanced.

Furthermore, in the PDP 200 of the present invention, as shown in FIG. 3, sustain discharge is generated only in portions defined by the first barrier ribs 208. Accordingly, unlike in the PDP 100, the ion-sputtering of the phosphor layers due to charged particles is prevented so that, even if the same image is displayed for a long period of time, no permanent image sticking is caused.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

a front substrate;

a rear substrate disposed in opposition to the front substrate;

first barrier ribs disposed between the front substrate and the rear substrate for defining discharge cells with the front substrate and the rear substrate, and formed of a dielectric material;

front discharge electrodes disposed inside the first barrier ribs so as to surround the discharge cells;

rear discharge electrodes spaced apart from the front discharge electrodes and disposed inside the first barrier ribs so as to surround the discharge cells;

phosphor layers disposed in the discharge cells; and a discharge gas deposited in the discharge cells;

wherein, from a longitudinal sectional view of the first barrier ribs, a virtual horizontal axis extending from a lowermost portion of each of the rear discharge electrodes and parallel to the front substrate intersects a lateral surface of the first barrier ribs at a certain position; and wherein an angle between a tangent line at an intersection of the horizontal axis and the lateral surfaces of the first barrier ribs, on one side, and a virtual vertical axis orthogonal to the horizontal axis, on another side, ranges from 4° to 17°.

2. The plasma display panel of claim 1, wherein the front discharge electrodes extend in a certain direction, and the rear discharge electrodes extend in a direction which crosses the certain direction in which the front discharge electrodes extend.

3. The plasma display panel of claim 1, wherein the front discharge electrodes and the rear discharge electrodes extend in directions which are parallel to each other;

said plasma display panel further comprising address electrodes extending in such a direction as to cross the directions in which the front discharge electrodes and the rear discharge electrodes extend.

4. The plasma display panel of claim 3, wherein the address electrodes are disposed between the rear substrate and the phosphor layers.

5. The plasma display panel of claim 3, further comprising a dielectric layer to cover the address electrodes.

6. The plasma display panel of claim 1, further comprising second barrier ribs which define the discharge cells with the first barrier ribs.

7. The plasma display panel of claim 6, wherein the phosphor layers are disposed on lateral surfaces of the second barrier ribs.

8. The plasma display panel of claim 1, wherein each of the front discharge electrodes and each of the rear discharge electrodes has a shape of a ladder.

9. The plasma display panel of claim 1, wherein at least lateral surfaces of the first barrier ribs are covered by protective layers.

* * * * *